US007780250B2

(12) United States Patent
Knowles

(10) Patent No.: US 7,780,250 B2
(45) Date of Patent: Aug. 24, 2010

(54) COLLAPSIBLE BAR

(76) Inventor: Simon Knowles, Steep House, Dark Lane, Chalford Stroud, Gloucestershire (GB) GL6 8QD ( * ) Notice: Subject to any disclaimer, the term of this patent is extended or adjusted under 35 U.S.C. 154(b) by 1156 days.

(21) Appl. No.: 10/517,523

(22) PCT Filed: Jun. 10, 2003

(86) PCT No.: PCT/GB03/02498

§ 371 (c)(1),
(2), (4) Date: Dec. 13, 2004

(87) PCT Pub. No.: WO03/103449

PCT Pub. Date: Dec. 18, 2003

(65) Prior Publication Data

US 2006/0055291 A1 Mar. 16, 2006

(30) Foreign Application Priority Data

Jun. 11, 2002 (GB) ..... 0213313.0

(51) Int. Cl.
*A47B 96/18* (2006.01)

(52) U.S. Cl. ..... 312/140.2

(58) Field of Classification Search ..... 312/257.1, 312/258, 140.1, 140.2, 140.3, 140.4, 265.1, 312/265.2, 265.4, 265.5, 265.6; 108/99, 108/101, 162, 157.16, 157.15, 157.17, 157.18, 108/157.13, 158.12, 159.11, 176, 155, 24, 108/25; 126/25 R
See application file for complete search history.

(56) References Cited

U.S. PATENT DOCUMENTS 1,093,119 A * 4/1914 Donavan ..... 160/135
1,411,260 A * 4/1922 Baker et al. ..... 108/107
1,913,387 A * 6/1933 Hayward ..... 312/140.2
1,937,935 A * 12/1933 Zimmerman ..... 108/110
2,411,620 A * 11/1946 English ..... 312/140.2
2,457,536 A * 12/1948 Doggett et al. ..... 312/140.2
2,604,213 A * 7/1952 Bales et al. ..... 108/188
D171,856 S * 3/1954 Mont ..... D6/430
2,771,334 A * 11/1956 Wahlbom ..... 312/140.2
2,808,305 A * 10/1957 Jackson ..... 312/140.2
3,033,632 A * 5/1962 Felten ..... 312/140.2
3,140,133 A * 7/1964 Kraft ..... 312/140.2
3,319,801 A * 5/1967 Nordstrom ..... 211/199

(Continued)

FOREIGN PATENT DOCUMENTS

DE 2808855 A * 9/1979

(Continued)

OTHER PUBLICATIONS

UK Patent Office, Search Report for Application GB 0213313.0, Dated Dec. 5, 2002.*

*Primary Examiner*—Janet M Wilkens
(74) *Attorney, Agent, or Firm*—Young & Thompson

(57) ABSTRACT

A collapsible bar (10) includes first and second support members (12), a surface element (14), and members for releasably latching the surface element (14) to the first and second support members (12). Preferably, the releasable latching members include an elongate channel (36) on each support member (12) and two skirt-portions (38) on the surface element (14). Each skirt-portion (38) is receivable in a respective elongate channel (36) as a close fit.

5 Claims, 5 Drawing Sheets

U.S. PATENT DOCUMENTS

| | | | | | |
|---|---|---|---|---|---|
| 3,365,258 | A | * | 1/1968 | Downing | 312/140.2 |
| 3,472,476 | A | * | 10/1969 | Johnson | 248/245 |
| 3,498,239 | A | * | 3/1970 | Bartlett et al. | 108/110 |
| 3,532,403 | A | * | 10/1970 | Koski | 312/140.2 |
| 3,644,011 | A | | 2/1972 | MacDonald | |
| 3,841,728 | A | * | 10/1974 | Petersen et al. | 312/140.2 |
| 3,848,375 | A | * | 11/1974 | White | 52/71 |
| 3,949,902 | A | * | 4/1976 | Thompson | 222/129.1 |
| 4,034,683 | A | * | 7/1977 | DiCenzo | 108/107 |
| 4,319,793 | A | * | 3/1982 | Suttles | 312/257.1 |
| 4,691,644 | A | * | 9/1987 | Frydman | 108/187 |
| 4,699,067 | A | * | 10/1987 | Okopny | 108/186 |
| 4,747,644 | A | * | 5/1988 | Gallery et al. | 312/140 |
| 5,251,790 | A | * | 10/1993 | Cohn et al. | 222/146.6 |
| 5,257,701 | A | * | 11/1993 | Edelson | 211/149 |
| 5,382,087 | A | * | 1/1995 | Pouch | 312/140.2 |
| 5,415,302 | A | * | 5/1995 | Carlson et al. | 211/187 |
| 5,915,602 | A | * | 6/1999 | Nelson | 222/608 |
| 5,997,113 | A | | 12/1999 | Benson | |
| 6,684,576 | B2 | * | 2/2004 | Grandin | 52/36.1 |
| 6,758,352 | B2 | * | 7/2004 | Gervasi | 211/149 |
| 7,240,975 | B2 | * | 7/2007 | DeMars | 312/140.2 |
| 7,354,120 | B2 | * | 4/2008 | DeMars | 312/140.2 |

FOREIGN PATENT DOCUMENTS

| | | | |
|---|---|---|---|
| DE | 3738255 C | * | 5/1989 |
| DE | 39 02 554 | | 8/1990 |
| GB | 2258139 A | * | 2/1993 |

* cited by examiner

COLLAPSIBLE BAR

This invention relates to a collapsible bar.

Social functions, such as held in a pavilion or marquee, often have a temporary bar set up to serve drinks and snacks. However, the bar is often arranged from trestles and planks of wood, or tables, with a large table cloth positioned thereover to enhance the overall aesthetic appeal. Such an arrangement can be unstable, often does not provide a suitably organised environment for serving different drinks, and does not look particularly attractive or professional.

The present invention seeks to overcome this problem.

According to the present invention, there is provided a collapsible bar comprising first and second support members, a surface element, and means for releasably latching the surface element to the first and second support members.

The invention will now be described, by way of example, with reference to the accompanying drawings, wherein.

Figure 1:
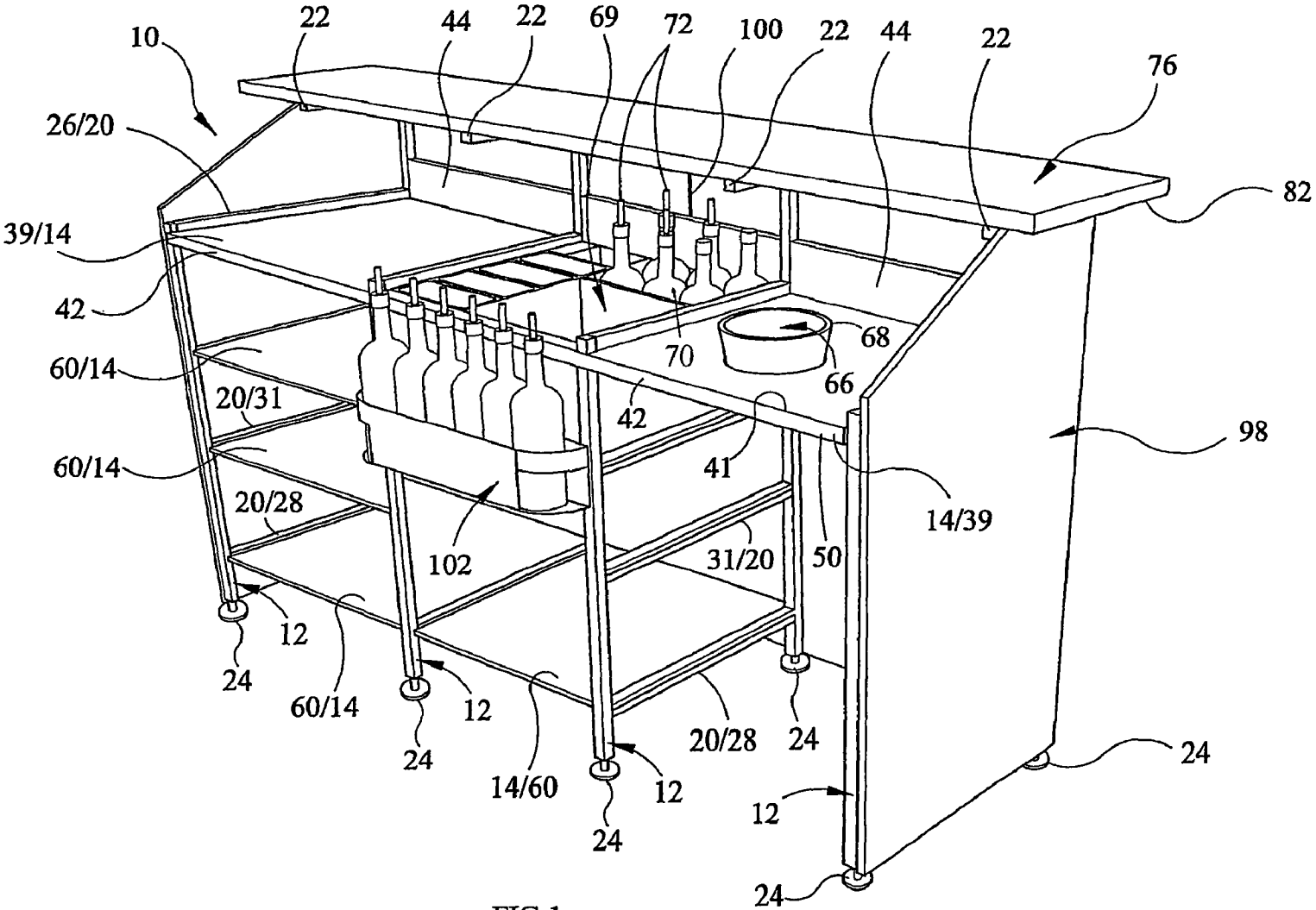
FIG. 1 shows a perspective view of one embodiment of a collapsible bar, when assembled, in accordance with the present invention.

Referring to the drawings, a collapsible bar 10 is shown having a plurality of support members 12, a plurality of surface elements 14 which can be selectively supported between the support members 12, and means for releasably latching the surface elements 14 to the support members 12.

The number of support members 12 is selected depending on requirements and can vary from two to any number. In this case, four support members 12 are shown.

Each support member 12 is in the form of a stainless steel frame having, in use, tubular vertical front and back uprights 16 and 18 and a plurality of horizontal cross-members 20 which interconnect the front and back uprights 16 and 18. The back upright 18 extends above the front upright 16 and includes a bar-top support member 22 projecting perpendicularly or substantially perpendicularly from its top end towards or substantially towards the longitudinal axis of the front upright 16.

Each front and back upright 16 and 18 includes an adjustable foot support 24 projecting from its bottom end to help stabilise the bar 10 once erected.

Figure 4:
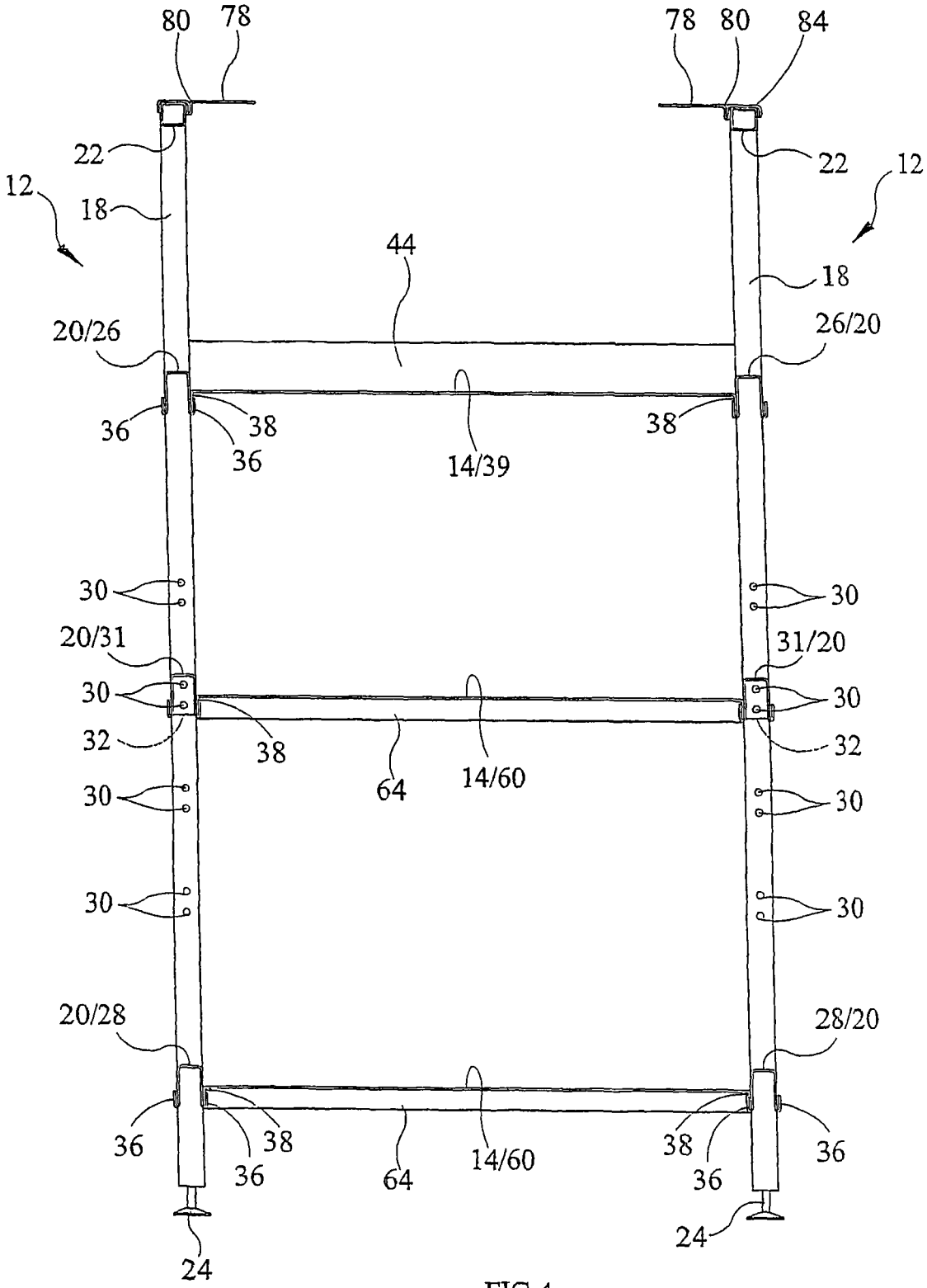
FIG. 4 is a sectional view taken along the line A-A in FIG. 3.

The top and bottom cross-members 26 and 28 are, typically, welded to the front and back uprights 16 and 18. The front and back uprights 16 and 18 also include sets of through-holes 30 (best seen in FIG. 4) by which the remaining cross-members 31 can be releasably supported by the front and back uprights 16 and 18 via movable screw-threaded support devices, such as bolts (not shown) and internally threaded, typically nylon, lugs 32. Consequently, the releasable cross-members 31 can be repositioned as necessity dictates.

Figure 5:
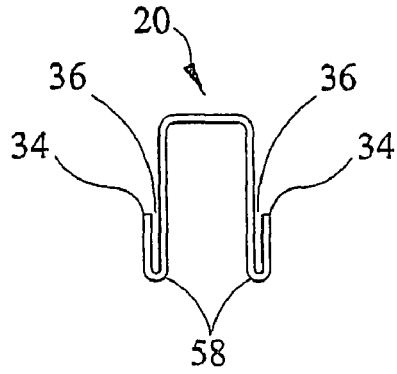
FIG. 5 is an enlarged view of part of releasable retaining means shown in FIG. 4.

As best seen in FIG. 5, all the cross-members 20 have an inverted U-shaped or substantially U-shaped transverse cross-section. Each bottom longitudinal free-edge 34 of each cross-member 20 is outwardly upturned to form an open-ended elongate channel 36.

A range of surface elements 14 are provided which can perform different functions. Each surface element 14 is formed from stainless steel and includes two side skirt portions 38 which project downwards from opposing side edges 40 of the surface element 14.

When the surface element 14 is a work surface element 39, the opposing side skirt portions 38 are interconnected along the front edge 41 of the work surface element 39 by a front skirt portion 42 and an upstanding splash plate 44 is formed along the back edge 46 of the work surface element 39.

The front skirt portion 42 of the work surface element 39 extends lower than the side skirt portions 38. Each side skirt portion 38 therefore includes a step 48 down to the level of the bottom edge 50 of the front skirt portion 42.

Figure 6:
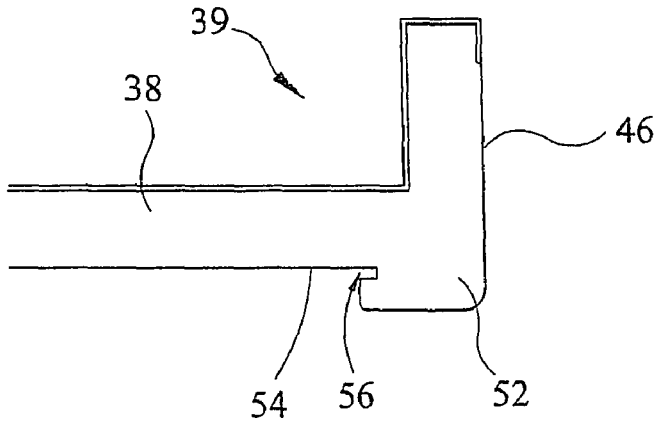
FIG. 6 is an enlarged view of part of a latch element shown in FIG. 4.

Each side skirt portion 38 is also formed with a depending latch element 52 or hook (best shown in FIG. 6) on a free-edge 54 adjacent to the back edge 46 of the work surface element 39. The latch element 52 projects towards the front edge 41 of the work surface element 39 so that a recess 56 is formed dimensioned to receive the open-ended edge 58 of the elongate channel 36.

On the other hand, when the surface element 14 is simply a shelf surface element 60, the opposing side skirt portions 38 are interconnected along the front and back edges 41 and 46 of the shelf surface element 60 by front and back skirt portions 62 and 64, thus creating an endless skirt.

The provision of the endless skirt portion or the provision of the front skirt portion 42 and the splash plate 44 enhances the rigidity of the surface element.

One work surface element 39 includes an aperture 66 for waste disposal. A suitable waste container (not shown) can be held in the aperture, or the aperture can support a chute 68 which leads to a suitable waste container (not shown) positioned there beneath.

Further work surface elements 39 include a recess (not shown) dimensioned to function as a sink for washing up; a recess 69 dimensioned to function as an ice-chest or -bucket; and one or more openings or recesses 70 dimensioned to receive one or more bottles 72 or glasses (not shown). Other functions, such as beer wells and drainer counters, can also be incorporated into work surface elements 39.

Obviously, combinations of the waste disposal aperture 66, sink recess, ice-chest/-bucket recess 69, one or more bottle/glass openings or recesses 70, and any other included function may be utilised in a single work surface element 39.

Also, the surface elements 14, especially the shelf surface elements 60, may be perforated (not shown) for lightness.

The releasable latching means comprises the elongate channel 36 and the side skirt portions 38. The elongate channels 36 are dimensioned to be able to receive the side skirt portions 38 of the surface elements 14 as close fits.

To assemble the collapsible bar 10, a first pair of the frame support members 12 are supported in a generally in use vertical position. The required work surface element 39 is selected and its side skirt portions 38 are seated in the opposing elongate channels 36 of the top fixed horizontal cross-members 26. The work surface element 39 is then urged in a back edge-to-forward edge direction to engage the open-ended edges 58 of the elongate channels 36 with the latch elements 52. When the latch element 52 is engaged with the elongate channel 36, the step 48 in each side skirt portion 38 is slightly spaced forward of the front edge 41 of the respective elongate channel 36. This helps to prevent disengagement of the latch element 52 through incidental contact by a user pushing against the work surface element 39.

This part of the bar 10 thus becomes free standing.

One or more shelf surface elements 60 can then be selectively positioned on the bottom fixed horizontal cross-members 28 and/or the releasable cross-members 31.

A further frame support member 12 can then be attached to one of the erected frame support members 12, in a similar manner as described above, via a further selected work surface element 39 and, if needs be, one or more further shelf surface elements 60.

Since the shelf surface elements 60 have the endless skirt portion, when located in the elongate channels 36, any incidental contact that tends to move the shelf surface element 60 forwards or backwards causes the inner surface of the front skirt portion 62 or the back skirt portion 64 to contact the open-ended edges 58 of the elongate channels 36, thereby preventing further undesirable movement.

The various work surface elements 39 and the shelf surface elements 60 can thus be selected and positioned depending on requirements. The various work surface elements 39 and the shelf surface elements 60 are also repositionable and interchangeable with each other.

Figure 7:
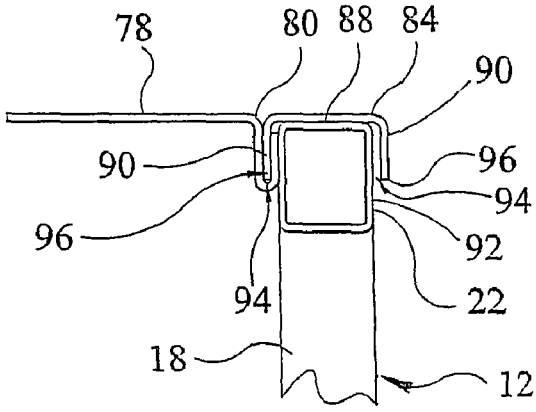
FIG. 7 is an enlarged view of part of bar-top retaining means shown in FIG. 4.

The collapsible bar 10 also includes a bar-top element 76 (shown in FIG. 1) which is supportable on the bar-top support members 22. Means for releasably retaining the bar-top element 76 on the bar-top support members 22 is provided, as best shown in FIG. 7. The releasable retaining means takes the form of a U-shaped or substantially U-shaped latch member 78 attached along one of its edges 80 to the underside 82 of the bar-top element 76 and an inverted U-shaped or substantially U-shaped complementary saddle member 84 fixedly seated on, and overhanging, the top surface 88 of each bar-top support member 22. The overhanging portions 90 of the saddle member 84 project downwards and are spaced from the sides 92, respectively, of the bar-top support member 22 to form inverted elongate channels 94.

The free-edge 96 of each latch member 78 is spaced from the underside 82 of the bar-top element.

To position the bar-top element 76 on the bar-top support members 22, the free-edges 96 of the latch members 78 of the bar-top element 76 are slide from one end into the corresponding inverted elongate channels 94. The inverted elongate channels 94 are dimensioned so that, when seated, the latch members 78 are held relatively tightly to prevent or inhibit accidental displacement of the bar-top element 76.

The bar-top element 76 is latchably jointed (not shown), typically across its width and using releasable latching means similar to that described above, to permit dismantling and/or extending of the bar-top element 76 so that it can assume different lengths and be conveniently stored.

However, the joints could be in the form of hinges to permit folding. The hinged joints can be dismantled and reconnected to enable the bar-top element 76 to assume different lengths.

Figure 2:
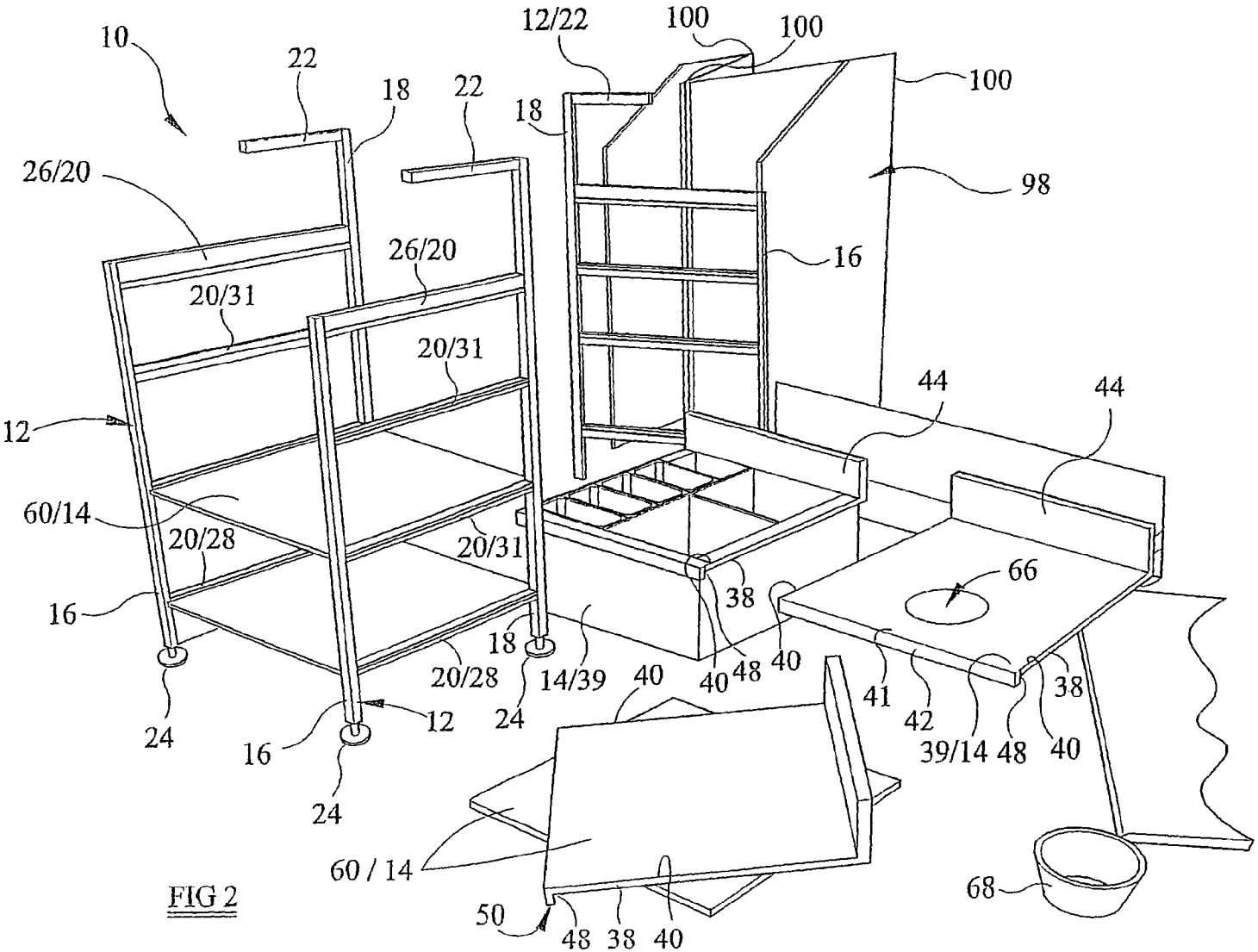
FIG. 2 shows the collapsible bar of FIG. 1 when partially dismantled.
Figure 3:
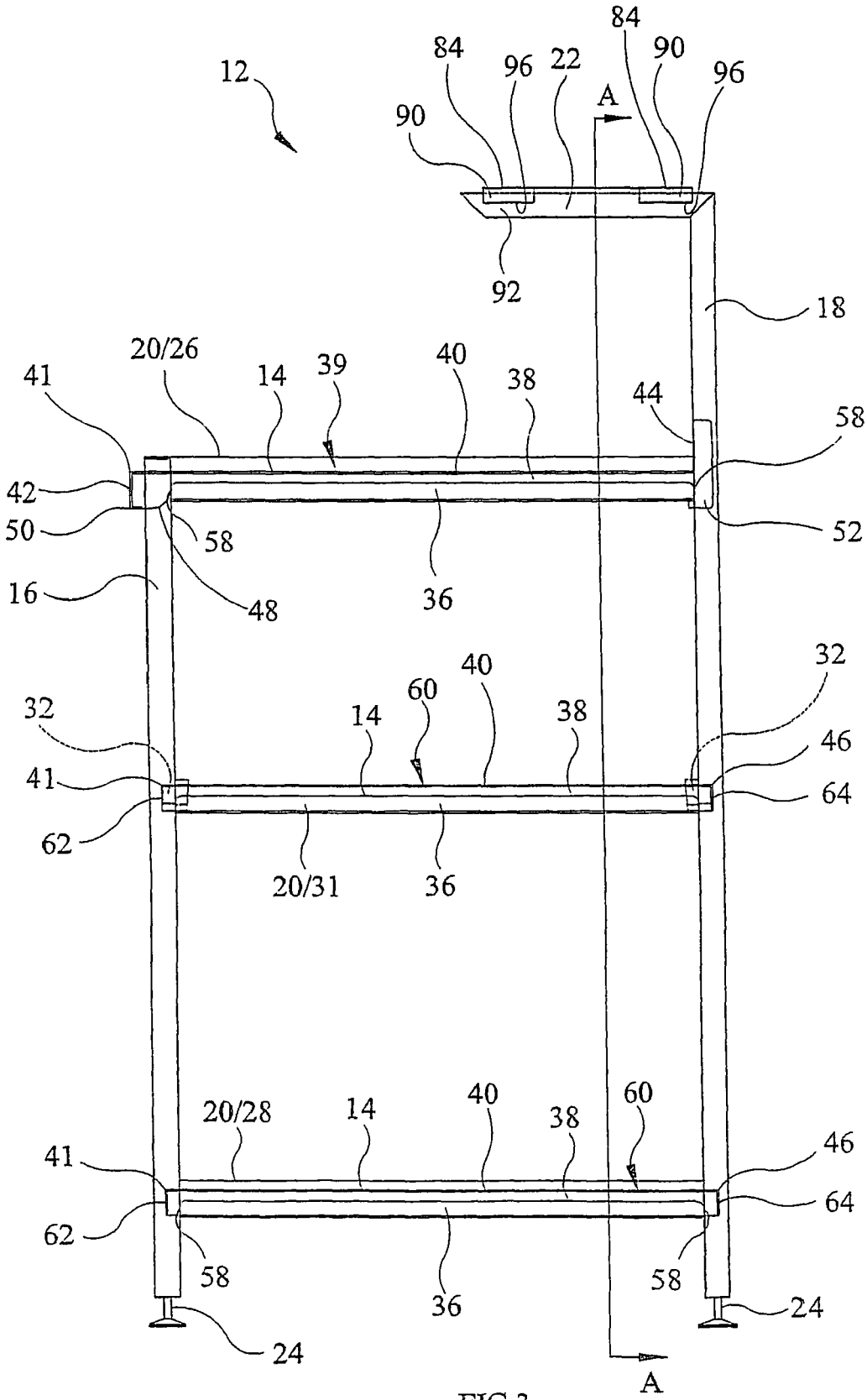
FIG. 3 is a side view of part of the collapsible bar shown in FIGS. 1 and 2.

A screen wall 98 is also provided for screening the front and sides of the erected bar 10 from patrons. The screen wall 98 is, similarly to the bar-top element 76, hingably jointed (best shown in FIG. 2) to enable convenient foldable storage. The hinged joints 100 can be dismantled and reconnected so that the screen wall 98 can accommodate different bar sizes.

The screen wall may be freestanding. However, the screen wall may be releasably latchable to the support members via releasable latching means similar to that described above.

The work surface elements may simply be formed with an endless skirt, instead of with a lower front skirt portion and a back splash plate.

Furthermore, the latch element could be dispensed with by forming the elongate channel with closed-ends.

As shown in FIG. 1, the front skirt portion of the surface element may be formed with a bottle rack 102 or, as the case may be, glass rack (not shown).

The support members may be formed from sheet material instead of being in the form of a frame. In this case, the elongate channels are formed on the sheet, for example by pressing or welding.

Also, although it is convenient to form a single elongate channel along one bottom longitudinal edge of the cross-member, a plurality of separate channels could be formed, for example one being adjacent to the front upright and one being adjacent to the back upright.

It is thus possible to provide a collapsible bar which can be temporarily erected in almost any location and sized to accommodate any requirement. It is also possible to provide a collapsible bar having the conveniences and functions of a permanent bar, and which is aesthetically pleasing. Furthermore, it is possible to provide a collapsible bar having selectively positionable, repositionable and interchangeable work surface elements and shelf surface elements.

The embodiment described above is given by way of example only and various modifications will be apparent to persons skilled in the art without other departing from the scope of the invention as defined by the appended claims.

The invention claimed is:

1. A collapsible bar comprising support members and means for releasably latching work surface elements to the support members, wherein there is a selectable number of the support members, the number of support members being variable from two to any number, wherein a plurality of selectable and interchangeable work surface elements having different functions are provided, each selected said work surface element being removably engagable with the support members via the releasable latching means, so that, when assembled, the said selected work surface elements interconnect the support members, and wherein at least one of the work surface elements includes one of a recess and an aperture through the work surface element, the said recess being suitable for use as at least one of a multi-bottle holder and an ice-chest, and the aperture being suitable for at least one of receiving and supporting a waste container therein and receiving a waste chute leading to a waste container, wherein a said surface element is removably positionable in a plurality of positions on the support members and is interchangeable with another surface element.

2. A collapsible bar comprising support members and means for releasably latching work surface elements to the support members, wherein there is a selectable number of the support members, the number of support members being variable from two to any number, wherein a plurality of selectable and interchangeable work surface elements having different functions are provided, each selected said work surface element being removably engagable with the support members via the releasable latching means, so that, when assembled, the said selected work surface elements interconnect the support members, and wherein at least one of the work surface elements includes one of a recess and an aperture through the work surface element, the said recess being suitable for use as at least one of a multi-bottle holder and an ice-chest, and the aperture being suitable for at least one of receiving and supporting a waste container therein and receiving a waste chute leading to a waste container, further comprising a bar-top element, which is supportable by the first and second support members, and means for releasably retaining the bar-top element on the first and second support members.

3. A collapsible bar comprising support members and means for releasably latching work surface elements to the support members, wherein there is a selectable number of the support members, the number of support members being variable from two to any number, wherein a plurality of selectable and interchangeable work surface elements having different functions are provided, each selected said work surface element being removably engagable with the support members via the releasable latching means, so that, when assembled, the said selected work surface elements interconnect the support members, and wherein at least one of the work surface elements includes one of a recess and an aperture through the work surface element, the said recess being suitable for use as at least one of a multi-bottle holder and an ice-chest, and the aperture being suitable for at least one of receiving and supporting a waste container therein and receiving a waste chute leading to a waste container, further comprising a screen wall for screening the front and sides of the in use bar from patrons.

4. A collapsible bar as claimed in claim 3, wherein the screen wall is hingeably jointed to enable folding.

5. A collapsible bar as claimed in claim 3, wherein the screen wall is freestanding.

* * * * *